United States Patent [19]

Nakai et al.

[11] 4,049,011

[45] Sept. 20, 1977

[54] COIN STACKING DEVICE

[75] Inventors: Shiro Nakai; Yoshio Nishikawa, both of Himeji, Japan

[73] Assignee: Glory Kogyo Kabushiki Kaisha, Japan

[21] Appl. No.: 719,382

[22] Filed: Aug. 31, 1976

[51] Int. Cl.[2] ..... G07D 9/06

[52] U.S. Cl. ..... 133/1 A; 53/212

[58] Field of Search ..... 133/1 A, 8 A, 8 B, 8 D; 53/212

[56] References Cited

U.S. PATENT DOCUMENTS 3,925,966 12/1975 Ushio ..... 53/212

FOREIGN PATENT DOCUMENTS 1,191,561 5/1970 United Kingdom ..... 133/1 A

*Primary Examiner*—Stanley H. Tollberg

*Attorney, Agent, or Firm*—Wenderoth, Lind & Ponack

[57] ABSTRACT

A coin stacking cylinder is assembled from three wall members and has a coin stacking space of a substantially circular cross section and variable diameter defined by a substantially semicylindrical concave surface formed by contiguously joined, arcuately recessed surfaces respectively of first and second, mutually displaceable wall members and defining a cavity and by an arcuately recessed surface of a third wall member, which is adjustably moved toward or away from the cavity to vary the diameter of the stacking space to suit any selected one of a plurality of different kinds of coins.

2 Claims, 6 Drawing Figures

COIN STACKING DEVICE

BACKGROUND OF THE INVENTION

This invention relates generally to coin handling and processing apparatuses such as coin counting machines and coin packaging machines and more particularly to a coin stacking device in such apparatuses. More specifically, the invention relates to a coin stacking device which is applicable for stacking coins of any of numerous kinds with great differences in their diameters and, at the same time, is adapted to impart effectively vibration for aligning coins fed thereto into a neat stack.

Heretofore, coin stacking devices in coin processing apparatuses have generally been of two types. In one of these known types, a cylindrical structure is formed simply as two halves by splitting along a plane passing through the centerline of the structure, each half having a semicylindrical concave inner surface. The two halves are placed in opposition with their concave inner surfaces facing each other to form a space for aligning and stacking coins. By causing one of the halves to move toward or away from the other, the structure can be used to stack coins of kinds of different diameters.

In the other known type of coin stacking device, a plurality of blades or slats are arranged to stand vertically on the circumference of a circle thereby to form a structure with a prismatic inner space for stacking of polygonal shape in cross section. By displacing all slats simultaneously in unison, the inner diameter of the inner space of this structure can be expanded or contracted to accommodatively adjust the device for stacking of different diameters.

In the former type, there is no particular problem when it is to be used for kinds of coins whose diameters do not differ very much from each other. However, when there are great differences in the coin diameters, and the stacking structure halves are set for coins of large diameter, the inner space formed by the convave inner surfaces of the opposed halves of the stacking structure assumes a cross section of an elongated figure with semi-circular ends, in which circular coins cannot be readily accommodated, whereby "end-on" standing of coins can easily occur.

Then, in order to obtain an inner space of a cross section approaching a true circle, the concave inner surface of each half of the stacking structure must be made to have a cross section of a shallow arcuate shape. By this expedient, however, the structure halves are greatly separated for large diameter coins, whereby, when vibration is imparted to the coins for aligning them into a stack, the coins tend to catch against the gap formed between the halves, and biting in of the coins tends to occur in the event of fluctuations in the amplitude of the two halves and the like. As a result, a good stacked state of the coins cannot be obtained.

In the latter known type of coin stacking device, the circle inscribed within the polygonal inner space of the stacking cylinder is a true circle, which is considered to have a good stacking function for coins of different diameters. However, since there is a limit to the number of the slats, the inner space is always of a polygonal cross section. For this reason, there occur instances wherein the coins drop therethrough along the corner parts and side parts of the polygonal inner surface or instances wherein they drop between a side and another side of the inner surface. Consequently, the dropping conditions of the coins differ greatly with the result that the dropping attitude of the coins is not constant, and within this type of stacking device, also, "end-on" standing of coins is caused.

Thus, not only is it impossible to obtain a satisfactory stacking action with this type of stacking cylinder, but the mechanism for uniform displacement of the numerous, slats with their root parts on a circle tends to become complicated, and smoothly expanding and contracting the stacking cylinder is very difficult.

SUMMARY OF THE INVENTION

It is an object of this invention to provide a coin stacking device in which the above described difficulties accompanying known coin stacking devices are overcome, and coins supplied into the device are stacked smoothy and neatly without undesirable occurrences such as "end-on" standing, catching, and jamming of the coins.

According to this invention, briefly summarized, there is provided a coin stacking device characterized in that a coin stacking cylinder is formed by first, second, and third wall elements or members and has a coin stacking space of a cross section approaching a true circle defined by a substantially semicylindrical surface formed by contiguously joined, arcuately recessed surfaces respectively of the first and second wall members and defining a cavity and an arcuately recessed surface of the third wall member closing the opening of the cavity, and in that the diameter of the coin stacking space is adjustably varied to suit any selected one of a plurality of different kinds for coins by accordingly moving the third wall member toward or away from the cavity thereby to cause the second wall member to undergo a swinging movement relative to the first wall member.

According to this invention, furthermore, there is provided a coin stacking device of the above stated character in which vibration applying means are provided to cause all wall members to undergo oscillatory vibration in the same direction about a single axis without variation of the diameter of the coin stacking space.

The nature, principles, and further features of this invention will be more clearly apparent from the following detailed description with respect to one preferred embodiment of the invention when read in conjunction with the accompanying drawings, throughout which like parts are designated by like reference numerals and characters.

DETAILED DESCRIPTION OF THE INVENTION

Figure 1:
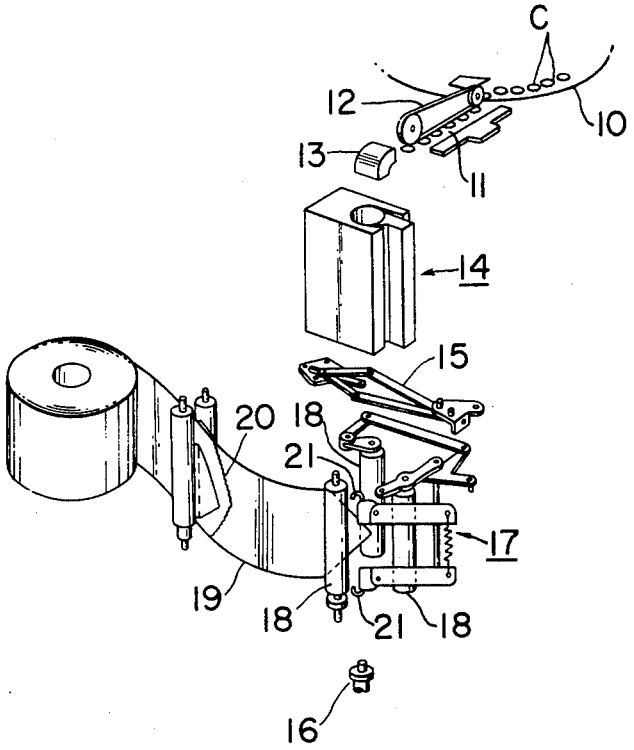
FIG. 1 is a schematic prespective view showing some operative components, including a coin stacking device according to this invention, of an automatic coin packaging apparatus by way of explanation of a mode of use of the coin stacking device.

By way of explanation of a mode of use of a coin stacking device according to this invention an automatic coin wrapping apparatus of known design will first be described with reference to FIG. 1. Coins C on a rotary disc 10 are successively centrifugally delivered onto a coin passage 11 and are moved therealong by an endless belt 12. On their way to a guide 13, those of the coins of a smaller diameter than the predetermined coin diameter may be automatically removed through an opening, not shown, formed suitably in the coin passage 11. A counter, not shown, is also provided on the coin passage 11 to release only a prescribed number of coins into a coin stacking device 14 through the guide 13. The coin stacking device 14 shown here is constructed in accordance with the present invention.

Since a shutter 15 at the bottom of the coin stacking device 14 is now assumed to be closed, the coins are successively stacked in the substantially cylindrical space within the coin stacking device 14. When the desired number of coins have been thus duly stacked, the motion of the endless belt 12 is automatically stopped, while the shutter 15 is opened by cam means or the like not shown in the drawing. The coins are then supported on a movable guide rod 16 which has been elevated to the level of the bottom of the shutter 15. As the guide rod 16 is succeedingly lowered into coin wrapping means 17, the coins are held among a plurality of rollers 18. The leading end of a continuous strip of wrapping paper 19 is now caught between the stack of coins and one of the rollers. By the rotation of these rollers the wrapping paper is coiled on the periphery of the stack of coins, and is severed off the continuous strip by a cutter 20 owing to its own tension thus exerted.

A pair of crimping hooks 21, positioned at the top and the bottom of the stack of coins, are simultaneously operated to tightly crimp fold the side edges of the wrapping paper on the ends of the coins. Since the guide rod 16 is retracted to the position illustrated in FIG. 1 at the instant when the coins are caught among the rollers 18, the duly wrapped stack of coins is dropped downwardly when released by these rollers. For uninterrupted coin wrapping operation, the shutter 15 may be closed as soon as the coins are delivered to the coin wrapping means 17 by the guide rod 16.

In the coin stacking device 14 according to this invention, there is provided a vertical coin stacking cylinder A which has a length sufficient for stacking a specific number of coins and is made up of first, second, and third wall members 31, 32, and 33.

Figure 4:
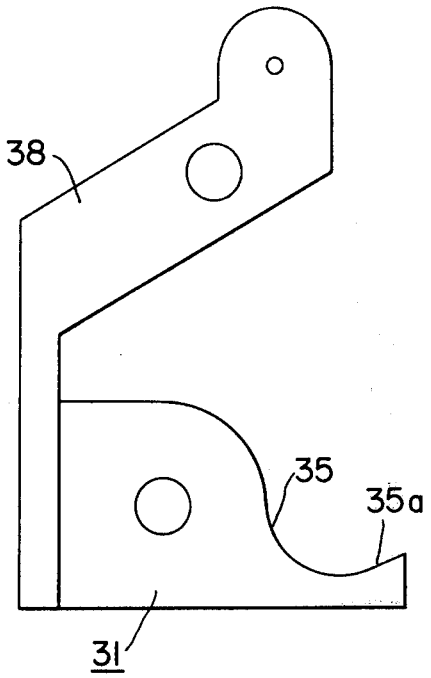
FIGS. 4(*a*), 4(*b*), and 4(*c*) are plan views respectively showing parts which, when assembled, form a coin stacking cylinder.
Figure 4:
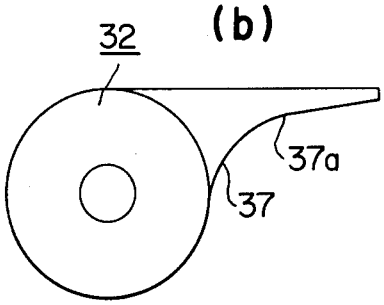
Figure 4:
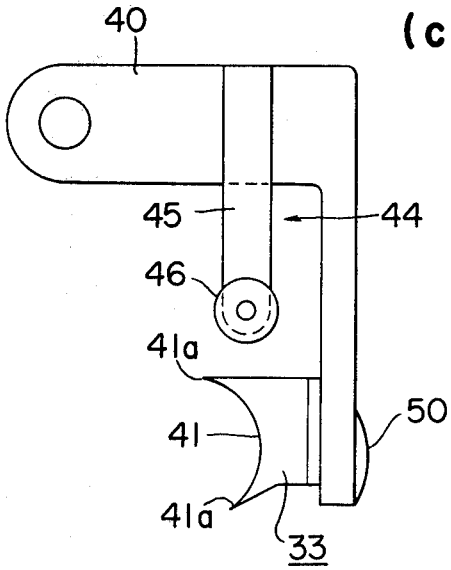

The first wall member 31 is supported swingably about a vertical shaft 34 supported by a rigid structural part of the apparatus and has a distal end part having an arcuately recessed curve surface 35 as shown in FIG. 4(*a*). At its other end part, the first wall member 31 is provided with an arm 38 rigidly fixed at its proximal end to the wall member 31.

The second wall member 32 is supported rotatably about a vertical axis coaxial with the shaft 34 supporting the first wall member 31. This second wall member 32 has a distal end part formed with an arcuately recessed curve surface 37, as shown in FIG. 4(*b*), which, together with the above mentioned curved surface 35 of the wall member 31, forms a cavity 36 of semicylindrical cross section as viewed in FIG. 2.

The third wall member 33 is fixed to the distal end of a support arm 40 swingably supported by a pivot pin 39 on the distal end of the above mentioned arm 38. The inner part of this third wall member 33 is in the form of curved surface 41 having an arcuate cross section as shown in FIG. 4(*c*) and ending at tip edges 41*a*, 41*a*, which are adapted to contact extension surfaces 35*a* and 37*a* of the above described curved surfaces 35 and 37 of the first and second wall members 31 and 32 to form a continuous inner wall surface and thereby to close the open part of the semicylindrical cavity 36 formed by the curved surface 35 and 37. Thus, the semicylindrical cavity 36 and the curved surface 41 of the third wall member 33 form a hollow cylindrical space of a closed cross sectional shape approaching a true circle for stacking of coins therein.

The above mentioned support arm 40 and the second wall member 32 are continually urged toward each other by a tension spring 42 stretched therebetween. Furthermore, the support arm 40 is urged by a tension spring 43 to rotate in the direction (counterclockwise as viewed in FIG. 2) to cause the third wall member 33 to retract from the cavity 36.

The degree of opening of the second wall member 32 relative to the first wall member 31 is regulated by a regulating device 44 comprising a strut 45 fixed to the support arm 40 and projecting therefrom toward the second wall member 32 and a roller 46 rotatably supported at the outer tip of the strut 45. The roller 46 abuts against the outer side of the projecting end part of the second wall member 32 thereby to maintain a constant positional relationship between the support arm 40 and the second wall member 32. Thus, the regulating device 44 limits the movement of the second wall member 32 urged by the force of the spring 42 to rotate in the direction to open or widen the cavity 36 and causes the second wall member 32 to rotate relative to the first wall member 31 in accordance with the movement of the third wall member 33 toward or away from the cavity 36.

The inner diameter of the coin stacking cylinder A is varied by adjusting means disposed at the back side of the support arm 40 and comparising, essentially, a cam 53, means (not shown) for adjustably rotating the cam 53, and an actuating lever 48 pivotally supported at a middle part thereof by a pivot pin 47 and functioning to transmit adjustment movements from the cam 53 to the distal end of the support arm 40, on which the third wall member 33 is mounted.

One end of the actuating lever 48 rotatably supports a cam follower roller 52 in contact with the cam 53, which is provided around its periphery with cam surfaces with radii respectively corresponding to different diameters of different kinds of coins for which the stacking device is designed. The roller 52 is maintained continually in contact with the cam 53 by a tension spring 54.

The other end of the actuating lever 48 rotatably supports a roller 49 in contact with a contact surface 50 provided on the distal end of the supporting arm 40 at the back side thereof. The contact surface 50 is an arcuately curved convex surface with its center at the centerline of the aforementioned shaft 34, whereby the roller 49 is not displaced about the pivot pin 47 when the arm 38 and the support arm 40 are both driven by a vibration applying mechanism 51 to undergo minute rotational vibration about the shaft 34.

The vibration applying mechanism 51 comprises a lever 55 pivoted at one end thereof on the distal end of the aforementioned arm 38, projections 56, 56 such as rollers provided at spaced-apart positions on the lever 55, an eccentric cam 57 disposed between and contacting the projections 56, 56, a driven gear $G_2$ fixed to a common shaft with the eccentric cam 57 and rotating unitarily therewith, a driving gear $G_1$ meshed with the driven gear $G_2$, and a motor for driving the gear $G_1$. Rotation of the cam 57 causes the lever 55 to undergo reciprocating motion, which causes the arm 38 and the support arm 40 to undergo a minute rotational oscillation about the shaft 34 thereby to impart vibration to the wall members 31, 32, and 33 of the coin stacking cylinder A.

The coin stacking device of the above described structural organization according to this invention operates in the following manner.

The aforementioned means (not shown) such as a control knob, for example, for adjustably rotating the cam 53 is manipulated to adjustably set the various adjustable mechanisms of the coin processing machine, including the above described coin stacking device, for processing a certain kind of coin, whereupon the cam 53 is adjustably rotated to present the relevant cam surface for contact by the cam follower roller 52. This immediately sets the position of the roller 49.

Figure 2:
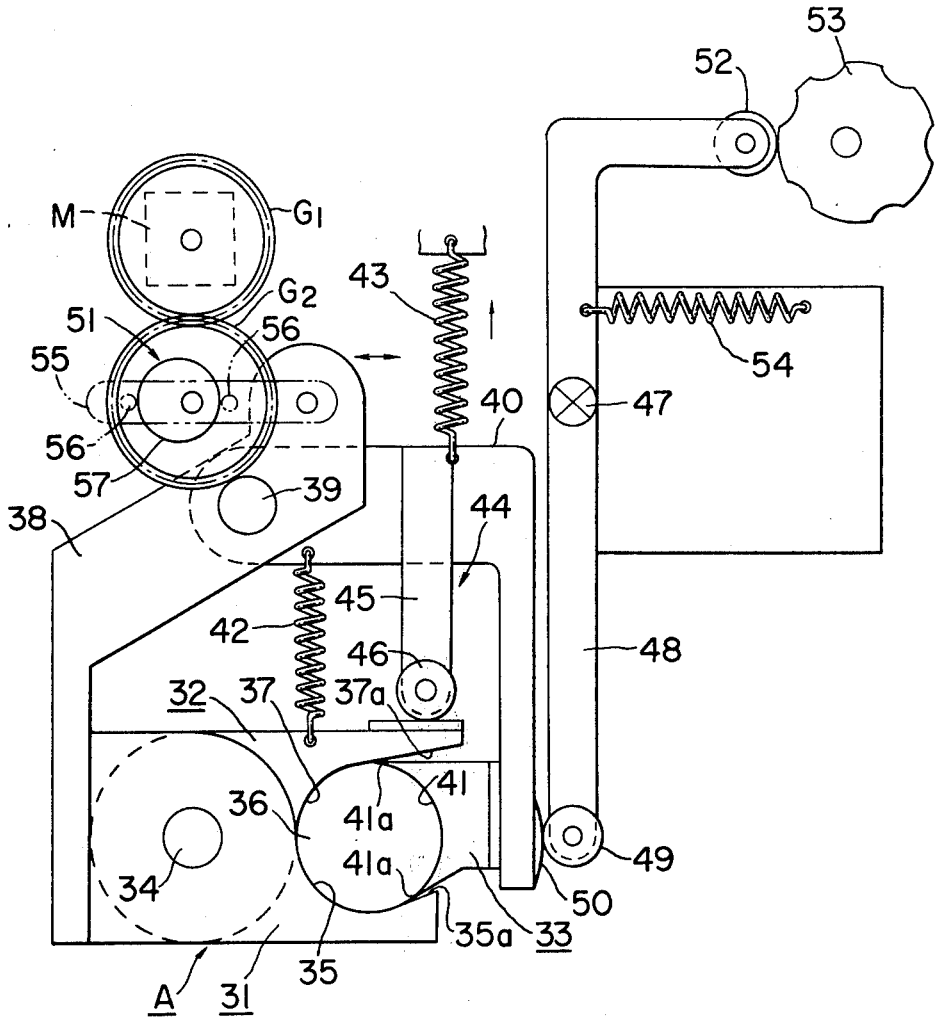
FIG. 2 is a plan view showing the essential mechanical organization of one example of a coin stacking device according to this invention.
Figure 3:
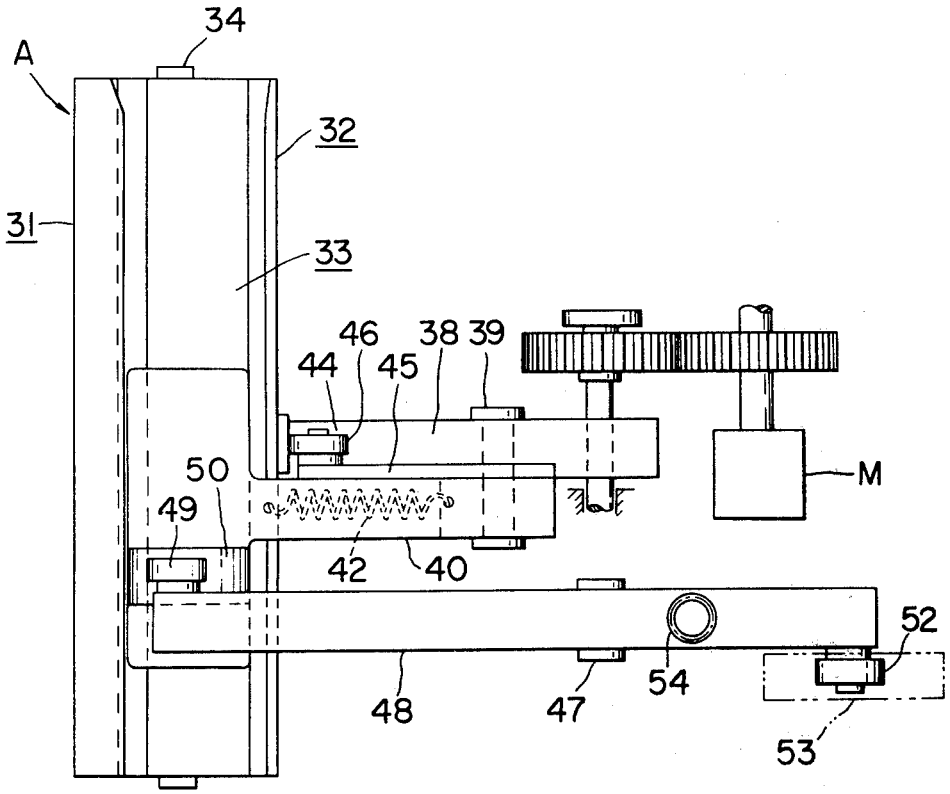
FIG. 3 is an elevation of the device shown in FIG. 2 as viewed from the right.

For example, in the case where, from the state indicated in FIG. 2, the machine is to be set for coins of a kind with a larger diameter, the cam 53 is rotated until the corresponding cam surface is contacted by the roller 52. This action causes the lever 48 to rotate in the counterclockwise direction, as viewed in FIG. 2, about the pivot pin 47 and the roller 49 to move in the direction away from the contact surface 50. Consequently the support arm 40 is rotated counterclockwise by the force of the spring 43 as it follows up the movement of the roller 49.

Together with this action, the regulating device 44 also retracts somewhat away from the second wall member 32, which is thereupon caused by the force of the spring 42 to rotate somewhat in the counterclockwise direction about the shaft 34. Consequently, the cavity 36 formed by the recessed curved surface 35 of the first wall member 31 and the recessed curved surface 37 of the second wall member 32 is expanded, and, as the third wall member 33 simultaneously retracts away from the cavity 36, the cylindrical space for coin stacking is expanded to assume a diameter appropriate for the kind of coin of greater diameter to be processed.

Conversely, in the case where the machine is to be set to process a kind of coin of smaller diameter, the cam 53 is adjustably turned to present the appropriate cam surface thereof for contract by the roller 52. Consequently, the lever 48 rotates clockwise about the pivot 47 as viewed in FIG. 2, and the roller 49 at its other end presses against the contact surface of the support arm 40. The third wall member 33 thereby advances toward the cavity 36, tracing an arcuate path with its center at the pivot pin 39. At the same time, the regulating device 44 of the support arm 40 presses against the second wall member 32 to contact the opening of the cavity 36 and to bring the recessed curved surfaces 35 and 37 into intimate contact with the tip edges 41*a*, 41*a*. Thus, the cavity 36 and the recessed curved surface 41 of the third wall member 33 are caused to cooperate in forming a stacking space appropriate for the kind of coin of small diameter to be processed.

After the three wall members 31, 32 and 33 have been set to form a stacking space of appropriate inner diameter in this manner, a predetermined number of the coins to be processed are supplied through the aforementioned coin passage 11 and guide 13 and into the stack space. At the same time, the motor M for applying vibration is started, whereupon power is transmitted through the gears $G_1$ and $G_2$ to rotate the eccentric cam 57, which, acting on the projections 56, 56, drives the lever 55 in reciprocating motion. Consequently, the arm 38, to which this lever 55 is coupled, undergoes rotational oscillation about the shaft 34, whereby the first wall member 31 constructed integrally with the arm 38 also undergoes minute rotational oscillation. The second wall member 32 pivotally supported on the shaft 34 of the first wall member 31 is caused through the regulating device 44 by the displacement of the support arm 40 supporting the third wall member 33 to undergo minute rotational oscillation together with the support arm 40. As a consequence, the first and second wall members 31 and 32 rotate through equal angles in the same direction, and, at the same time, the third wall member 33 also moves in the same direction in a manner to follow the first and second wall members 31 and 32.

Thus, the directions of the vibration applied to all wall members 31, 32, and 33 are always the same. As a result, the stacking cylinder A formed by the first, second, and third wall members 31, 32, and 33 vibrates without variation of the diameter of the stacking space defined by the recessed curved surfaces 35, 37, and 41 of the wall members.

Thus, in accordance with this invention as described above, there is provided a stacking device of a mechanical arrangement wherein first and second wall members defining a substantially semicylindrical cavity as they undergo opening and closing movement and a third wall member closing the opening of this cavity and having a recessed curved surface cooperating with the inner surface of the cavity to form a coin stacking space of a cross section which is substantially a true circle are vibrated in the same direction by a single vibration applying source. By this arrangement, the inner diameter of the stacking cylinder does not vary when the coins supplied thereinto are vibrated. Therefore, the stacked state of each batch of coins can be attained rapidly, and there is no possibility of coins being caught or forced between wall members during the application of vibration, whereby a good stacked state can be obtained.

Furthermore, since the recessed curved surfaces of all wall members are mutually contiguous and form a smooth inner wall surface without gaps between the wall members, there the cause of disturbance of the falling state of the coins dropped into the stacking space is removed. Accordingly, "end-on" standing of coins at the time of dropping in of the coins is positively prevented. Still another advantageous feature is that, since the stacking cylinder is constituted by the combination of three wall members, the assembled structure is extremely simple, and the adjustment of the inner diameter thereof is also very simple and positive, requiring only the advance or retraction of the third wall member. Therefore, the stacking device can be produced at low cost even when it is adapted to stack a large number of kinds of coins.

We claim:

1. A coin stacking device comprising:

a first wall member having an arcuately recessed curved surface rotatably supported on a first pivot shaft which is fixed in space;

a second wall member having an arcuately recessed curved surface disposed contiguously to said curved surface of the first wall member to form therewith a continuous curved surface defining a substantially semicylindrical cavity, said second wall member being rotatably supported on the first pivot shaft and being biased to rotate about the first pivot point in the direction to widen the cavity;

a support lever rotatably supported at one end thereof by a second pivot shaft fixed to an extended part of the first wall member and biased to rotate about the second pivot point in the direction to separate the other end thereof away from said cavity;

a third wall member supported on said other end of the support lever, thereby being movable toward and away from said cavity, and having an arcuately recessed curved surface opposed to said cavity and forming therewith a continuous curved surface of substantially circular cross section which is of variable diameter and defines a cylindrical space for stacking of coins supplied thereinto;

a regulating device provided on the support lever and functioning to determine the angular position of the second wall member relative to the first wall member thereby to determine the degree of opening of the cavity; and adjusting means adjustably operable to move the support arm thereby to adjustably vary the diameter of said cylindrical space to any selected one of a plurality of predetermined values corresponding to the diameters of different kinds of coins.

2. A coin stacking device as claimed in claim 1 further comprising a vibration applying device for applying vibration to said first, second, and third wall members, said vibration applying device comprising a vibration source and transmission means for transmitting vibration to the first, second, and third wall members thereby to cause the same to undergo minute oscillatory vibration in the same direction.

* * * * *